US007749112B2

(12) United States Patent
Hayden et al.

(10) Patent No.: US 7,749,112 B2
(45) Date of Patent: Jul. 6, 2010

(54) ONE PIECE LACROSSE STICK

(75) Inventors: Mark X. Hayden, Greenwich, CT (US); Chad M. Wittman, Boston, MA (US)

(73) Assignee: Harrow Sports, Inc., Denver, CO (US)

( * ) Notice: Subject to any disclaimer, the term of this patent is extended or adjusted under 35 U.S.C. 154(b) by 135 days.

(21) Appl. No.: 11/571,961

(22) PCT Filed: Apr. 29, 2005

(86) PCT No.: PCT/US2005/014988

§ 371 (c)(1),
(2), (4) Date: Jul. 24, 2007

(87) PCT Pub. No.: WO2006/022909

PCT Pub. Date: Mar. 2, 2006

(65) Prior Publication Data

US 2007/0281808 A1 Dec. 6, 2007

Related U.S. Application Data

(63) Continuation-in-part of application No. 10/710,719, filed on Jul. 29, 2004, now abandoned.

(51) Int. Cl.
*A63B 59/02* (2006.01)
*A63B 65/12* (2006.01)

(52) U.S. Cl. ..... 473/513; 264/512

(58) Field of Classification Search ..... 473/505, 473/512, 513; D21/724; 264/512
See application file for complete search history.

(56) References Cited

U.S. PATENT DOCUMENTS 2,596,894 A 5/1952 Frisch
3,755,037 A 8/1973 Erwin et al.
3,910,578 A 10/1975 Brine Jr.
3,910,758 A 10/1975 Brine, Jr.
4,358,117 A 11/1982 Deutsch
4,739,994 A 4/1988 Lewis, Jr.
5,312,102 A 5/1994 Stennett
5,556,677 A 9/1996 Quigley et al.
5,651,549 A 7/1997 Dill et al.
5,651,744 A * 7/1997 Millon et al. ..... 473/513
5,685,791 A * 11/1997 Feeney ..... 473/513
5,888,601 A 3/1999 Quigley et al.
6,113,508 A 9/2000 Locarno et al.

(Continued)

FOREIGN PATENT DOCUMENTS

CA 1 109 091 9/1981

(Continued)

OTHER PUBLICATIONS

Plasti Dip International "Plasti Dip Multi-Purpose Rubber Coating" 5 pages Jan. 22, 2002.

(Continued)

*Primary Examiner*—Gene Kim
*Assistant Examiner*—Mike Chambers
(74) *Attorney, Agent, or Firm*—Holland & Hart LLP

(57) ABSTRACT

The present invention provides a lacrosse stick (220) comprising a unibody head and shaft construction that increases lacrosse throwing accuracy and power.

10 Claims, 7 Drawing Sheets

U.S. PATENT DOCUMENTS

| | | | | |
|---|---|---|---|---|
| 6,261,500 | B1 | 7/2001 | Park et al. | |
| 6,500,079 | B1 * | 12/2002 | Tucker, Sr. | 473/513 |
| 6,752,730 | B1 | 6/2004 | Brine, Jr. et al. | |
| 6,910,976 | B2 * | 6/2005 | Tucker, Sr. | 473/513 |
| 2002/0055403 | A1 | 5/2002 | McCutchen | |
| 2003/0045380 | A1 | 3/2003 | Tucker, Sr. | |
| 2004/0002398 | A1 | 1/2004 | Morrow et al. | |
| 2004/0084815 | A1 * | 5/2004 | Blotteaux | 264/512 |

FOREIGN PATENT DOCUMENTS

| | | |
|---|---|---|
| CA | 1109091 | 9/1981 |

OTHER PUBLICATIONS

International Searching Authority, "Notification of Transmittal of the International Search Report and the Written Opinion of the International Searching Authority, or the Declaration" Mar. 8, 2006.

* cited by examiner

ONE PIECE LACROSSE STICK

RELATED APPLICATIONS

The patent application is a continuation-in-part of U.S. patent application Ser. No. 10/710,719, titled the same, filed Jul. 29, 2004, now abandoned incorporated herein by reference.

FIELD OF THE INVENTION

The present invention relates to lacrosse sticks and, more particularly, to a lacrosse stick comprising a single, molded, unibody shaft and head.

BACKGROUND OF THE INVENTION

Conventional lacrosse sticks today comprise a tubular metal shaft and a molded high density composite plastic head. The tubular metal shaft and head arrangement has been in existence since at least the mid 1970's, see for example, U.S. Pat. No. 4,037,841, title LACROSSE STICK HAVING TUBULAR METALLIC HANDLE, issued Jul. 26, 1977, incorporated herein by reference. FIG. 1 shows a conventional lacrosse stick 100 having a conventional metal shaft 102 and a conventional head 104. Shaft 102 further has a butt end 106 and a head end 108. Head 104 further has a base 110, divergent sidewalls 112, and a lip 114.

Extending from base 110 is a shaft junction projection 116 that comprises a female socket 118. Shaft junction projection 116 is a length d1. Head end 108 of shaft has a corresponding head junction projection 120 that comprises a male plug 122. Male plug 122 is shown as having a cross-section consistent with the remainder of metal shaft 102, but some conventional shafts have a male plug 122 with a reduced cross-section. Head junction projection 120 has a length d2, which typically is consistent with length d1. Frequently, shaft 102 and head 104 are secured using a pin or screw extending through both the shaft and head and secured using another pin or nut, not specifically shown but generally known in the art.

While the conventional shaft/head connection works, it has several drawbacks. One major drawback is that shaft junction projection 116 is considered part of head 104 and, by rule, a player using stick 100 cannot place his/her hands on the stick in such a way that the player's hand contacts head 104. Most players, however, prefer to have a hand placed as close to base 110 as allowable by rule. Using conventional stick designs, a player can place his hands on spot 124 that is a minimum distance d1 from base 110.

Another major drawback includes the fatigue the multiple components experience because they are separate and joined. In particular, head junction projection 120 typically has a bore (not specifically shown) that aligns with a similar bore in shaft junction projection 116. A bolt, screw and nut, pin, or the like typically traverses both shaft junction projection 116 and head junction projection 120 to secure head 104 to shaft 102. The projections 116 and 120, as well as the bolt and bore, typically experience fatigue during play. Lacrosse sticks and heads frequently have decreased performance because of the fatigued connection. Sometimes the equipment needs to be replaced.

Thus, it would be desirous to develop a lacrosse head that cured these and other deficiencies of the prior art.

SUMMARY OF THE INVENTION

The present invention relates to an improved lacrosse stick. In particular, the improved lacrosse stick comprising a unibody construction where the head and shaft are molded into a solitary unit.

The foregoing and other features, utilities and advantages of the invention will be apparent from the following more particular description of a preferred embodiment of the invention as illustrated in the accompanying drawings.

BRIEF DESCRIPTION OF THE DRAWING

The accompanying drawings illustrate various embodiments of the present invention and are a part of the specification. The illustrated embodiments are merely examples and illustrations of the present invention and do not limit the scope of the invention.

DETAILED DESCRIPTION

The present invention will now be described with reference to FIGS. 2 to 8. It is to be understood that the drawings are diagrammatic and schematic representations of the presently preferred embodiments, and are not limiting of the present invention, nor are they drawing to scale.

The present invention relates to an improved lacrosse stick comprising a lacrosse head and a lacrosse shaft connected such that the lacrosse head and lacrosse shaft are a unibody member without a discernable connection, such as, a socket and plug connection. One possible type of unibody member is a lacrosse stick comprising a head and shaft molded as a single unit from a composite material, which will be further explained below. Constructing the lacrosse stick as a unitary member will remove many of the fatigue issues associated with prior art connections using head and shaft projections. Further, constructing the lacrosse stick as a unitary or unibody member provided increased rigidity to the stick that increases throwing power and accuracy by moving the point at which the stick flexes during use lower on the shaft.

Figure 1:
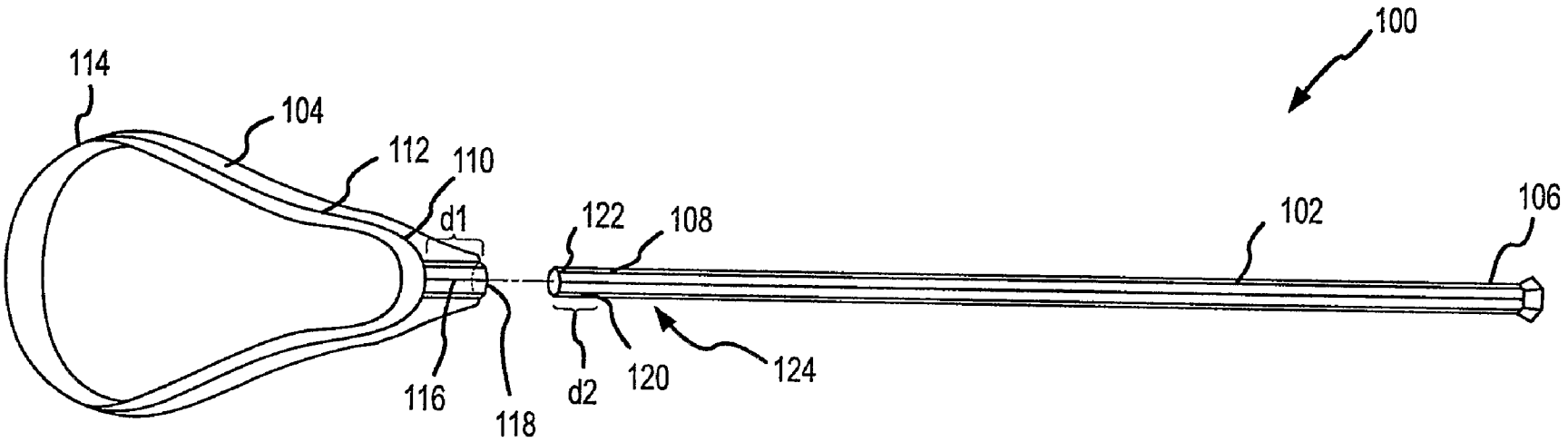
(PRIOR ART) FIG.1
FIG. 1 illustrates a conventional tubular lacrosse shaft and mating head.
Figure 2:
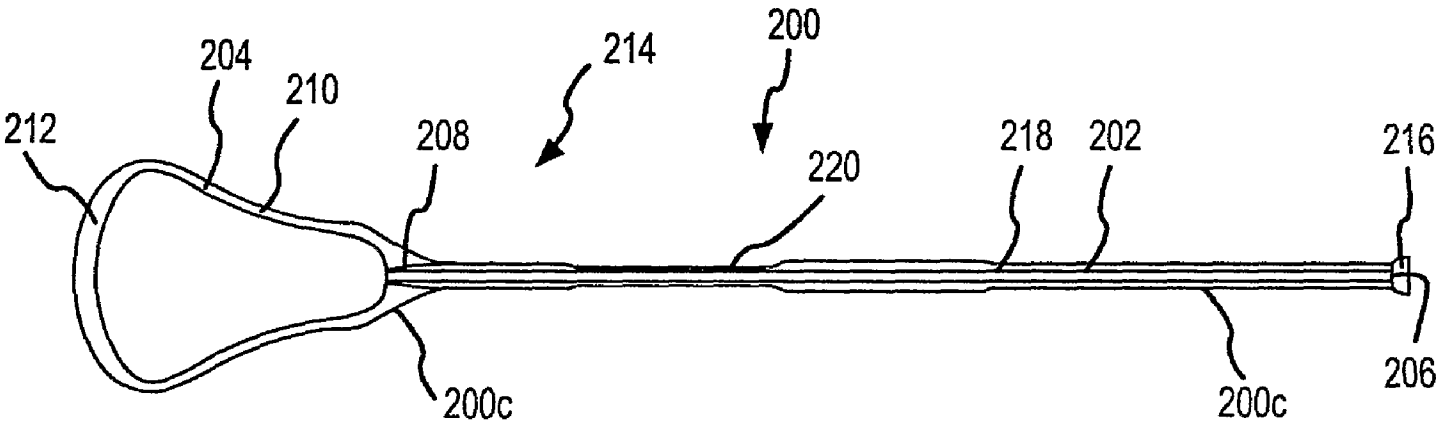
FIG. 2 is a top elevation view of a lacrosse stick constructed in accordance with an embodiment of the present invention.
Figure 3:
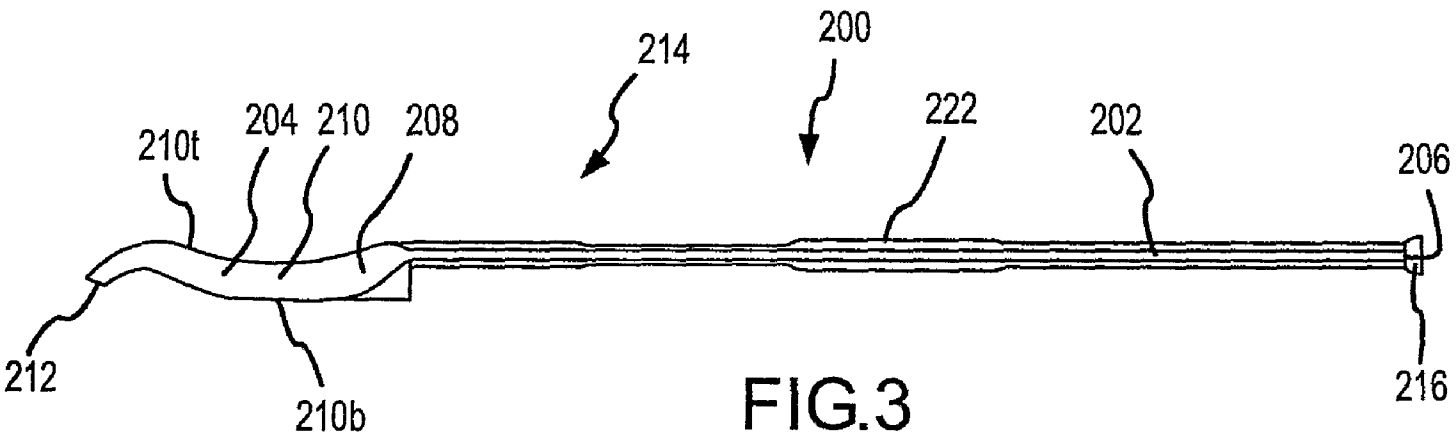
FIG. 3 is a side elevation view of a lacrosse stick constructed in accordance with an embodiment of the present invention.
Figure 4:
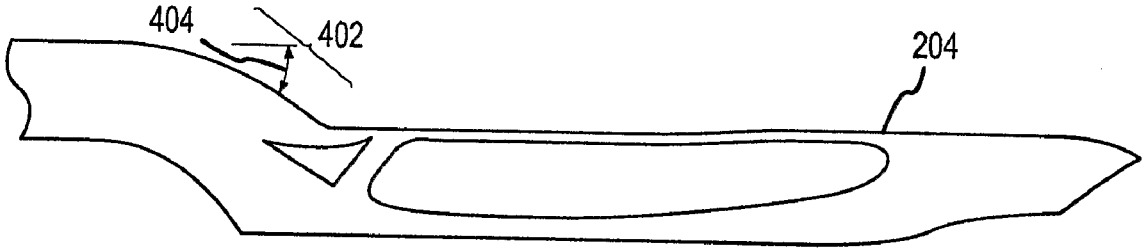
FIG. 4 is a side elevation view of a lacrosse head having steps.

Referring now to FIG. 2, a lacrosse stick 200 consistent with an embodiment of the present invention is shown. Lacrosse stick 200 includes a shaft 202 and a head 204. Shaft 202 has a butt end 206. Head 204 has a base 208 (or ball stop), divergent sidewalls 210, and a lip 212 traversing divergent sidewalls. Divergent sidewalls 210 have a top edge 210*t* and a bottom edge 210*b*. Transition portion 214 is a seamless transition section. While transition portion 214 is shown having a particular shape, the shape is largely a matter of design choice. Lacrosse stick 200 may be coated with a uniform rubberized coating 200C as disclosed in co-pending U.S. patent application Ser. No. 10/735,596, titled Sport Shaft, filed Dec. 12, 2003, incorporated herein by reference. Coating 200C provides asetetic quality of uniformness, but also may provide a temperature regulation quality to increase the comfort of handling the lacrosse stick 200.

As can be appreciated, transition portion 214 is shown to distinguish from the socket an plug construction of the prior art. Further, head 204 and shaft 202 may be constructed of different materials. When constructed of different materials, transition portion 214 provides a transition between shaft material A and head material B. Notice, transition portion 214 could be different materials C, a combination of the same materials A and B, a combination of materials A, B, and C, or the like. However, once cured, the transition from shaft 202 to head 204 through transition portion 214 will be seamless.

Butt end 206 comprises an end stop 216. End stop 216 could be integrated into shaft 206 using a unibody constructions similar to co-pending U.S. patent application Ser. No. 10/876,945, titled "Shaft with End Stop, filed Jun. 25, 2004, and incorporated herein by reference as if set out in full. Moreover, shaft body 218 could have one or more tapered section 220 or enlarged section 222 similar to co-pending U.S. patent application Ser. No. 10/735,596, and co-pending U.S. patent application Ser. No. 10/887,175, titled Sport Shaft with Variable Contour, filed Jul. 7, 2004, and incorporated herein by reference as if set out in full.

As shown in the FIGS., and described in the above incorporated co-pending applications, the head 204 and shaft 202 can be offset. The offset can be accomplished by an offset established in the shaft 202, such as, for example, at transition portion 214, or in the head 204. Moreover, the head may have a generally concave shape as shown to give the head a scoop contour. Finally, the shaft 202 can be curved along its length or along portions thereof instead of the traditional straight shaft designs.

One method of manufacturing the shaft 200 comprises use of graphite or other materials. According to this one embodiment, a graphite sheet is wrapped around an internal member such as a dowel. In this case, the member would have the designed with a shape similar to the shaft and head unibody construction described above. The number of times the graphite sheets is wrapped around the dowel determines the strength of the shaft. Therefore, stronger shafts may be wrapped multiple times. When the desired number of graphite layers has been achieved, the dowel is removed, leaving the graphite in a tubular arrangement. The tubular graphite is then inserted into a mold, where it is heated and formed into the mold shape, which in this case is a unibody lacrosse stick.

Similar composite sticks are shown and described in U.S. patent application Ser. No. 10/441,400, titled One-Piece Shaft Construction and a Method of Construction using Bladder Molding, filed May 20, 2003, by Blotteaux, and incorporated herein by reference described conventional carbon molding techniques. Unlike the present invention, however, Blotteaux relates mostly to straight devices or devices with simple curved shapes. Further, Blotteaux discloses a means for fusing two separate parts together to form a seamed stick unlike the seamless stick described above. In particular, Blotteaux partially wraps and partially forms two parts, mates the partially formed pre-wrapped parts, and finishes the process. However, Blotteaux and other conventional methods of making composite sticks are unsatisfactory for Lacrosse sticks. In particular, Blotteaux (and other conventional methods) relate specifically to hockey sticks and golf clubs. Both hockey sticks and golf clubs are formed using relatively simple non-complex shapes.

Lacrosse sticks comprise, however, a relatively simple non-complex shaft combined with a complex head shape. In particular, the head comprises base 208 (or ball stop), divergent sidewalls 210, and lip 212 traversing divergent sidewalls. Sidewalls 210 frequently are curved, see FIG. 3, or contain one or more steps 402, see FIG. 4. Step 402 is shown as an abrupt, acute angle step, but step 402 could be more gradual, more like an incline than a step, or more abrupt making an angle 404 up to and even exceeding 90 degrees, i.e., step 402 could be slightly undercut as desired. Moreover, step 402 could be located in shaft 202 instead of head 204. Unlike, for example, hockey sticks and golf clubs, using conventional dowels or mandrels (see mandrel 50 of Blotteaux) does not work satisfactorily for lacrosse heads because the dowel is relatively rigid and does not allow easy removal prior to curing or otherwise fixing the shape of the shape.

Figure 5:
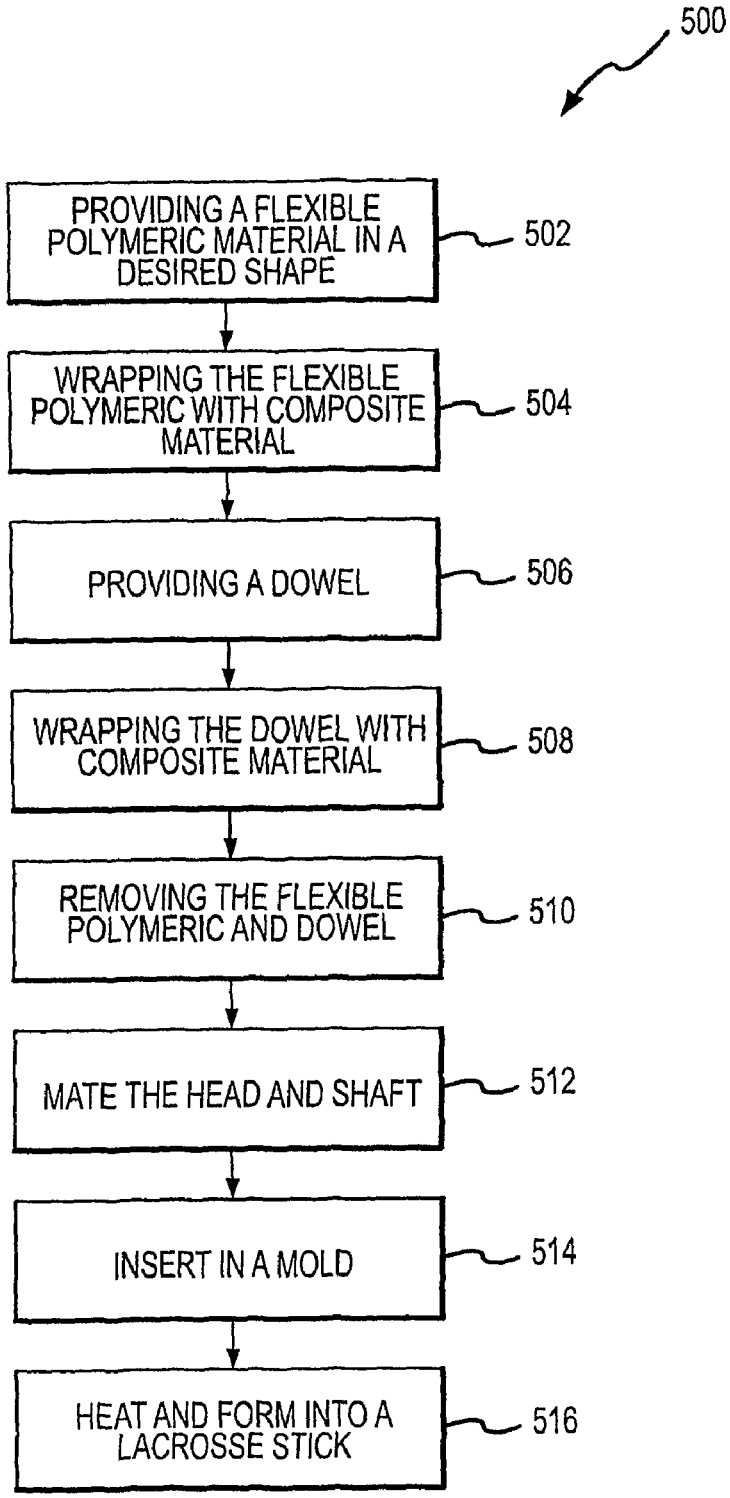
FIG. 5 is a flowchart illustrative of making a lacrosse stick in accordance with an embodiment of the present invention.
Figure 8:
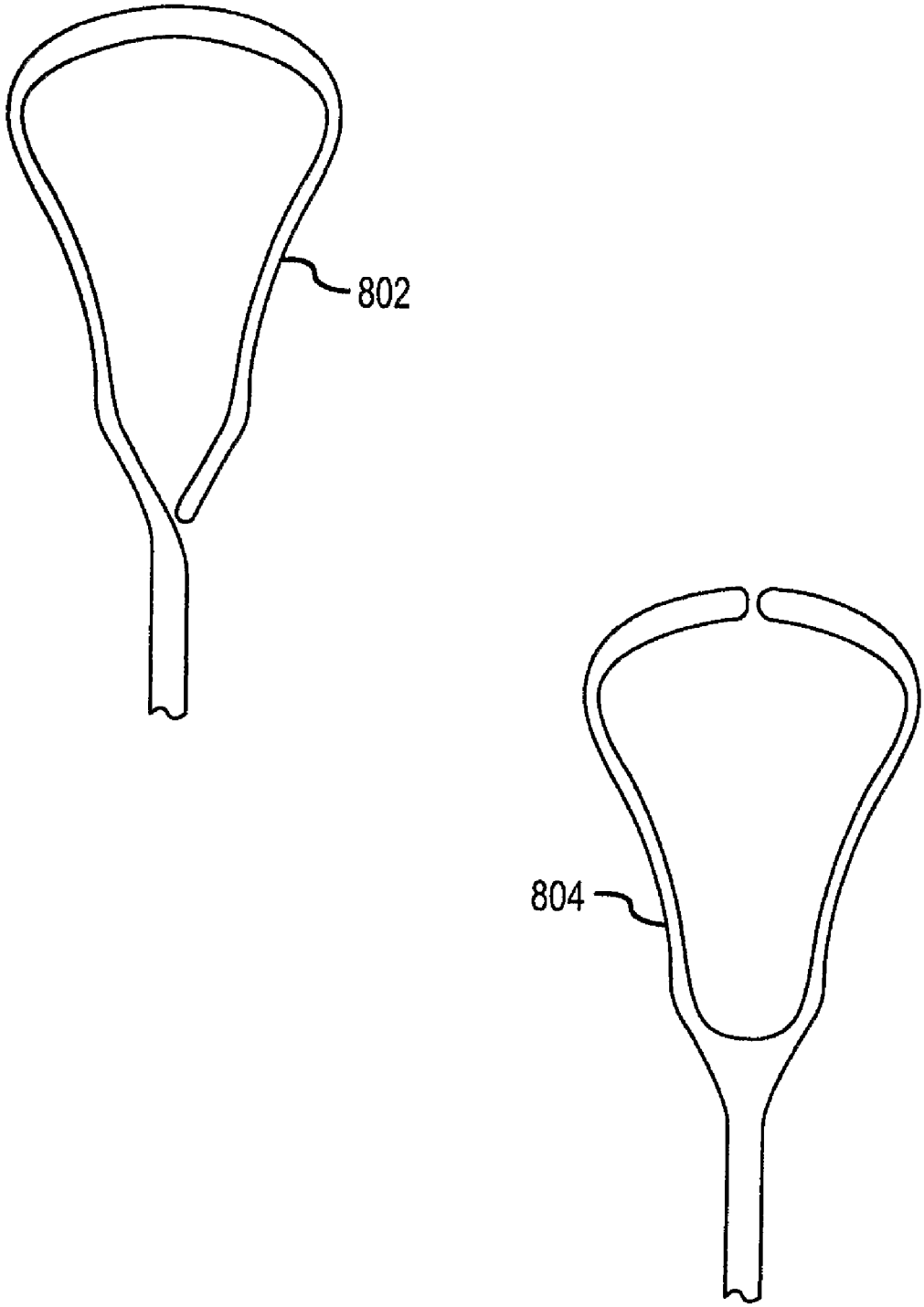
FIG. 8. shows a representation of the flexible polymeric material described in FIG. 5.

Thus, it is necessary to use a deformable or flexible polymeric material, see for example, FIG. 8 showing flexible polymeric material 802 and 804 formed into a lacrosse stick head shape, instead of conventional dowels for at least the head portion of the shaft, although flexible polymeric material could be used for the entire dowel including the head and shaft pre-curing formation. Moreover, flexible polymeric material 802 and 804 are shown as a single piece, they could each be made of two or more parts. Using flexible/deformable material allows the dowel to be removed prior to formation. Referring now to FIG. 5, a flowchart 500 illustrative of using flexible polymeric material to make one piece lacrosse sticks. Flowchart 500 is described using the flexible polymeric material for the head and a conventional dowel for the remainder of the stick as that is the more complex process, both one of skill in the art would understand the conventional dowel could be replaced by a flexible polymeric dowel. By flexible, it should be understood that the flexible polymeric dowel has sufficient rigidity to form a shape and be wrapped with the composite material, but retain sufficient flexibility that the flexible polymeric can be pulled, pushed, or otherwise drawn out of and removed from the wrap prior to the curing or fixation process.

Referring specifically to FIG. 5, comprises providing a flexible polymeric material shaped into a desired shape for a lacrosse stick head, step 502. The lacrosse stick head is wrapped with, for example, graphite sheets, a predetermined number of times, step 504. A dowel is provided, step 506. The dowel is wrapped with, for example, graphite sheets, a predetermined number of times, step 508. Steps 502/504 and 506/508 can be performed in multiple orders, which is largely a matter of design choice. Further, if a single dowel of flexible polymeric material is provided for both the head and shaft, steps 506/508 are collapsed into steps 502/504. Also, the dowel of steps 506/508 could be a conventional dowel or a separate flexible polymeric material dowel as desired. When the desired number of graphite layers has been achieved, the flexible polymeric and dowel are removed, step 510, leaving the graphite in a tubular arrangement. The head portion and shaft portion are mated, step 512, and inserted into a mold, step 514, where it is heated and formed into the mold shape, which in this case is a unibody lacrosse stick, step 516. Steps 512, 514, and 516 are conventional and will not be further explained herein. As can be appreciated, one flexible polymeric could be used for both the shaft and head.

Figure 6:
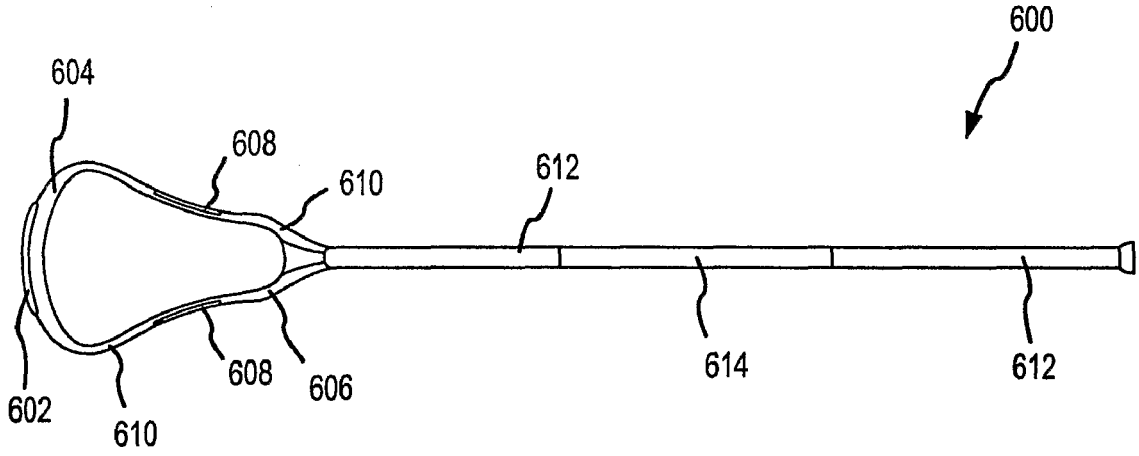
FIG. 6 shows another lacrosse stick constructed in accordance with an embodiment of the present invention.

Referring now to FIG. 6, another unibody lacrosse stick 600 is shown. Unibody lacrosse stick 600 is constructed using the flexible polymeric to allow at least the lacrosse head to be preformed prior to insertion into the mold. It has been found that other materials can be added to portions of the mold, such as, for example rubber bumper 602 in lip 604 of stick 600. This is allowable because the flexible polymeric can be shaped and wrapped in such a way that the rubber bumper 602 can be secured prior to insertion in the mold. Once finished, the rubber bumper 602 is a seamless part of stick 600, similar to the end stop identified above. Rubber additions can be made in numerous locations about the stick, but it has been found bumper 602 on lip 604 is particularly advantageous for unibody lacrosse stick 600. In particular, unibody lacrosse stick 600 has a head portion 606 that is more rigid than conventional heads, as identified in the prior art typically formed using injection molding techniques. Because it is stiffer, quite unexpectedly, the head portion 606 is able to drive through surface irregularities to assist in fielding a ground ball, for example. However, because head portion 606 is more rigid, it also does not flex with surface irregularities, causing nicks and other damage to lip 604. Rubber bumper 602 protects lip 604 from the nicks and other damage powering through surface irregularities or less rigid lacrosse stick heads cause. In addition or in the alternative, head portion 606 may have plastics, such as, for example, plastic edges 608 in sidewalls 610 of head portion 606. Plastics, similar to rubber, may be included in other portions of unibody lacrosse stick 600. Finally, metals could be molded into unibody lacrosse stick 600 as well. For example, the shaft portion 612 of unibody lacrosse stick 600 may have a metal section 614.

Figure 7:
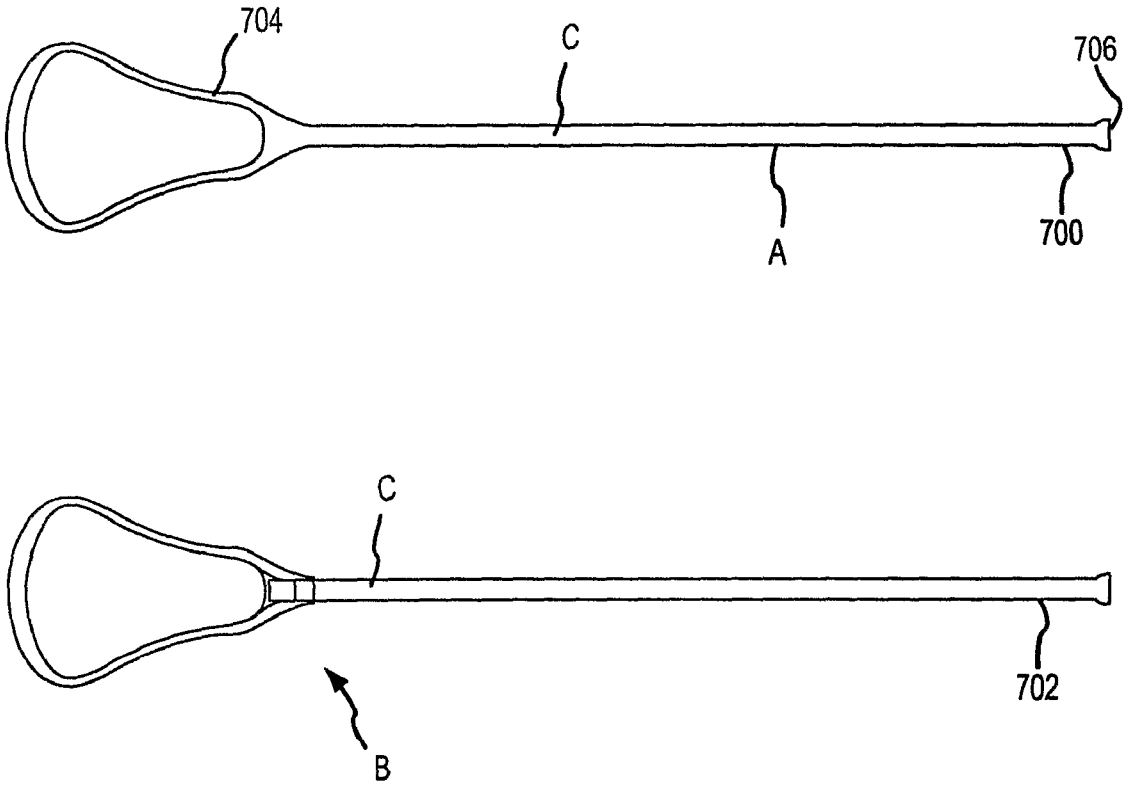
FIG. 7; shows a comparison of various points between a conventional lacrosse stick and a lacrosse stick constructed in accordance with an embodiment of the present invention.

Quite unexpected prior to the development of the unibody lacrosse stick of the present invention, the unibody lacrosse stick provides significant and unexpected benefits over conventional lacrosse sticks. Referring first to FIG. 7, a unibody lacrosse stick 700 consistent with the present invention is shown next to a conventional lacrosse stick 702. Unibody lacrosse stick 700 has a flex point A located on the shaft (point A is shown as a reference in FIG. 7 and is not shown to scale). Conventional lacrosse stick 702 has a flex point B, which is typically in the head portion (about the base in most cases) of the conventional lacrosse stick 702 because the injection molded plastic is the weaker point. Flex point A is below or lower than flex point B. Below or lower means flex point A is closer to butt end 706. Moving the flex point A lower than flex point B greatly, and unexpectedly, increases the accuracy and power of stick 700. This was unexpected because until the stick 700 was developed, it was unknown that the flex point on conventional stick 702 was significantly too high. It has been found that having flex point A about 1 to 2 feet below where flex point B is on conventional sticks works well, but the best results seem to occur when flex point A is about 1.5 feet below where flex point B is on conventional sticks. In addition to stick 700 have a better location of the flex point A, unlike convention stick 702, which typically has an injection molded head, stick 700 reduces the flex of the head portion 704. This also increases accuracy and power.

Another advantage of stick 700 is that it is significantly lighter than conventional sticks, but also stronger. One prototype of stick 700 weights between about 300 to 350 grams and specifically about 320 grams whereas conventional sticks of comparable length and thickness weight about 360 to 380 grams. Moreover, the reduced head weight causes the stick to have significantly greater balance than conventional sticks, with the balance point C of stick 700 being below balance point D of stick 702. Balance point C and flex point A could be designed to coincide as a matter of design choice.

While the invention has been particularly shown and described with reference to an embodiment or embodiments thereof, it will be understood by those skilled in the art that various other changes in the form and details may be made without departing from the spirit and scope of the invention.

We claim:

1. A method of making a unibody lacrosse stick, comprising the steps of:

providing a continuous flexible polymeric material;

shaping the flexible polymeric material into a shaped flexible polymeric material, the shape flexible polymeric material being in a shape of a lacrosse head such that the shaped flexible polymeric material comprises at least one curve;

wrapping the flexible polymeric material with a first composite material such that the first composite material is in the shape of the lacrosse head with at least one curve;

removing the shaped flexible polymeric material from, the first composite material such that the shape of the shaped flexible polymeric material flexes about the at least one curve as the flexible polymeric material is removed from the first composite material;

inserting the first composite material in the shape of the lacrosse head into a mold with a second composite material shaped into the shape of a lacrosse shaft, the second composite material having a transition end proximate the first composite material and a butt end opposite the transition end; and heating the first composite material and the second composite material to form a seamless, unibody lacrosse stick comprising the lacrosse head and the lacrosse shaft.

2. The method of making a unibody lacrosse stick of, claim 1, further comprising the steps of:

providing a dowel in a shape of a lacrosse shaft;

wrapping the dowel with the second composite material such that the second composite material is shaped into the shape of a lacrosse shaft; and removing the dowel to leave the second composite material in the shape of the lacrosse shaft.

3. The method of claim 1 wherein the first composite material and the second composite material are the same composite material.

4. The method of claim 3 wherein the first composite material is selected from a group of composite materials consisting of: carbon fiber or graphite.

5. The method of claim 1 wherein the step of shaping the flexible polymeric material into the shape of the lacrosse head comprises a plurality of curves.

6. The method of claim 1 further comprising the step of placing a bumper along a portion of the first composite material such that the bumper is molded into the first composite material during the heating step.

7. The method of claim 2 further comprising placing an end stop in the butt end of the second composite material such that the end stop is molded into the lacrosse, shaft.

8. The method of claim 2 wherein wrapping the second composite material around the dowel includes the step of wrapping the dowel with a different number of wraps in at least one place on the dowel.

9. The method of claim 8 wherein the wrapping the second composite material around the dowel includes providing less wrapping proximate the transition end to provide a flex point.

10. The method of claim 8 wherein the wrapping the second composite material around the dowel includes providing more wrapping proximate the butt end and distal the transition end to provide a grip portion.

* * * * *